US006939247B1

(12) United States Patent
Schweigert et al.

(10) Patent No.: US 6,939,247 B1
(45) Date of Patent: Sep. 6, 2005

(54) GOLF CLUB HEAD WITH HIGH CENTER OF GRAVITY

(75) Inventors: Bradley D. Schweigert, Anthem, AZ (US); Anthony D. Serrano, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/812,650

(22) Filed: Mar. 29, 2004

(51) Int. Cl.[7] ..... A63B 53/02; A63B 53/04
(52) U.S. Cl. ..... 473/314; 473/345; 473/349
(58) Field of Search ..... 473/324, 345, 473/346, 349, 290, 291, 292, 350, 314, 342, 473/329

(56) References Cited

U.S. PATENT DOCUMENTS

| | | | | |
|---|---|---|---|---|
| 5,310,186 A | | 5/1994 | Solheim | |
| 5,797,807 A | * | 8/1998 | Moore | 473/345 |
| 5,851,160 A | * | 12/1998 | Rugge et al. | 473/349 |
| 5,854,460 A | | 12/1998 | Rugge | |
| 5,935,020 A | * | 8/1999 | Stites et al. | 473/345 |
| 5,947,840 A | * | 9/1999 | Ryan | 473/335 |
| 5,954,596 A | * | 9/1999 | Noble et al. | 473/346 |
| 6,033,320 A | * | 3/2000 | Bamberger | 473/314 |
| 6,334,817 B1 | * | 1/2002 | Ezawa et al. | 473/324 |
| 6,604,568 B2 | | 8/2003 | Bliss et al. | |
| 6,716,114 B2 | * | 4/2004 | Nishio | 473/314 |
| 6,776,726 B2 | * | 8/2004 | Sano | 473/330 |
| 2004/0048681 A1 | * | 3/2004 | Nishio | 473/314 |
| 2004/0048682 A1 | * | 3/2004 | Kouno et al. | 473/314 |
| 2004/0157678 A1 | * | 8/2004 | Kohno | 473/314 |
| 2004/0162156 A1 | * | 8/2004 | Kohno | 473/314 |

* cited by examiner

*Primary Examiner*—Sebastiano Passaniti
(74) *Attorney, Agent, or Firm*—Darrell F. Marquette; John D. Titus

(57) ABSTRACT

A golf club head is formed of a hollow metal body having a center of gravity that is above the geometric center of the club face. The hollow metal body of the club head has a sole plate that is smoothly contoured and devoid of any inefficient structures such as weight pads or other mass concentrations. By avoiding the use of inefficient structures such as weight pads, more material is available for the structural walls of the club head body while maintaining the club head within acceptable weight limitations. Moreover, placement of the center of gravity above the center line of the face ensures that sufficient backspin will be imparted to the golf ball when struck by the club.

9 Claims, 3 Drawing Sheets

GOLF CLUB HEAD WITH HIGH CENTER OF GRAVITY

BACKGROUND OF THE INVENTION

This invention relates generally to golf clubs and, in particular, to so-called metal wood drivers.

Recent developments in golf club design have included improvements in drivers, which are clubs used primarily to strike a golf ball resting on a golf tee. These improvements have resulted in drivers with club heads consisting of a hollow shell usually made of metal, such as steel, aluminum, or titanium. These hollow shells typically have a weight pad located on the sole of the club for the purpose of moving the center of gravity downward toward the sole and inward toward the heel of the club head. One example of a golf club head consisting of a hollow metal shell with a weight pad is disclosed in U.S. Pat. No. 5,851,160 to Rugge, et al. According to Rugge, et al., moving the center of gravity to a position below the center of the impact face reduces the amount of backspin imparted to the golf ball by creating a counteracting torque couple between the impact point and the center of gravity of the club.

In an effort to obtain better and better performance from these hollow metal wood drivers, golf club manufacturers have increased the head volume from a moderate volume of 250 cc's as disclosed in Rugge, et al. to over 400 cc's in recent years. As head size increases, less and less material is available for inefficient structures such as weight pads while maintaining the club head of these super-oversized drivers within acceptable weight limitations (i.e., around 200 grams mass). Moreover, as the club head volume increases, the moment of inertia of the club heads also increase, leading to poor performance if prior art methods of locating the center of gravity below the center of the club face are followed.

SUMMARY OF THE INVENTION

The present invention comprises a golf club head formed of a hollow metal body having a center of gravity that is above the geometric center of the club face. According to a preferred embodiment of the present invention, the hollow metal body of the club head has a sole plate that is smoothly contoured and devoid of any inefficient structures such as weight pads or other mass concentrations. By avoiding the use of inefficient structures such as weight pads, more material is available for the structural walls of the club head body while maintaining the club head within acceptable weight limitations. Moreover, placement of the center of gravity above the center line of the face ensures that sufficient backspin will be imparted to the golf ball when struck by the club.

BRIEF DESCRIPTION OF THE DRAWING

The present invention will be better understood from a reading of the following detailed description, taken in conjunction with the accompanying drawings figures in which like references designate like elements and, in which.

DETAILED DESCRIPTION

Figure 1:
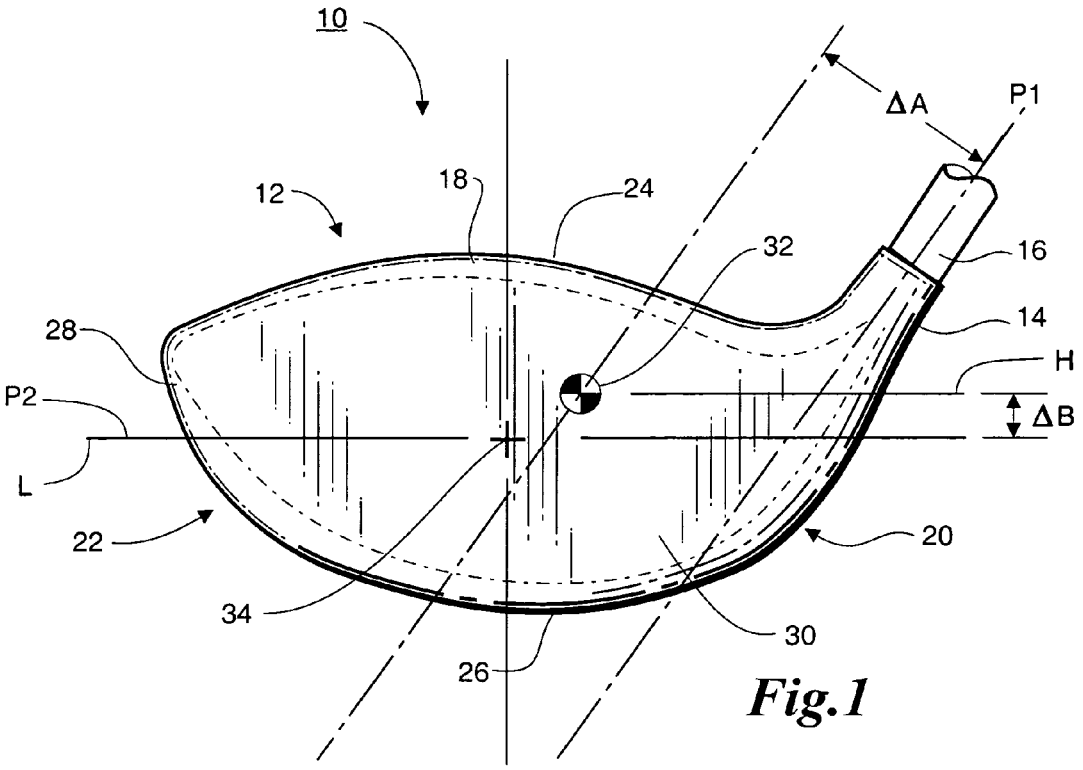
FIG. 1 is a front view of a golf club head incorporating features of the present invention.

The drawing figures are intended to illustrate the general manner of construction and are not necessarily to scale. In the detailed description and in the drawing figures, specific illustrative examples are shown and herein described in detail. It should be understood, however, that the drawing figures and the detailed description are not intended to limit the invention to the particular form disclosed but are merely illustrative and intended to teach one of ordinary skill how to make and/or use the invention claimed herein and for setting forth the best mode for carrying out the invention.

Referring to FIG. 1, golf club 10 includes a head 12, a hosel 14 and shaft 16. Head 12 includes a hollow body 18 having a heel end 20 and a toe end 22. Hollow body 18 is formed as a shell composed of a crown 24, a sole 26 and a skirt 28 connecting the crown and the sole together. Hollow body 18 may be assembled from a series of forged pieces, but in the illustrative embodiment, comprises a titanium investment casting. A face plate 30 preferably comprises a rolled sheet titanium blank having a machined rear surface that tapers from 4.0±1.5 millimeters proximal the center to 2.5±1.0 millimeters proximal the perimeter. The surface area of the face is in excess of 29 $cm^2$ and preferably is from 29 to 36 $cm^2$. Face plate 30 is attached by conventional means such as plasma or electron beam welding to a corresponding opening in hollow body 18 to form club head 12.

Club head 12 has a center of gravity 32 that is located inside hollow body 18, which, when projected in plan view onto face plate 30, is above the geometric center 34 of the face of club head 12. In a preferred embodiment, center of gravity 32 is located at a distance ΔB of 2.1±2.0 millimeters, preferably 2.0±1.0 millimeters above a horizontal plane "$P_2$", through the geometric center of the face 34. As noted previously, the prior art teaches locating the center of gravity of the golf club head below the geometric center of the face so that the backspin gear effect tends to counteract the normal loft-induced backspin of the golf club. What the inventors of the present invention discovered, however, is that when head size is in excess of 350 cc's or so, the moment of inertia of these super-oversized clubs is so great that locating the center of gravity of the club head below the center of the face would produce unnecessarily low backspin for stable flight. In the preferred embodiment, the moment of inertia about horizontal axis "H" through the center of gravity 34 is over 800 Kg-$cm^2$, preferably, as much as 890 Kg-$cm^2$ Such a large moment of inertia about the horizontal axis renders the club head extremely resistant to backspin gear effect, thereby enabling location of the center of gravity above the geometric center of the face.

Figure 2:
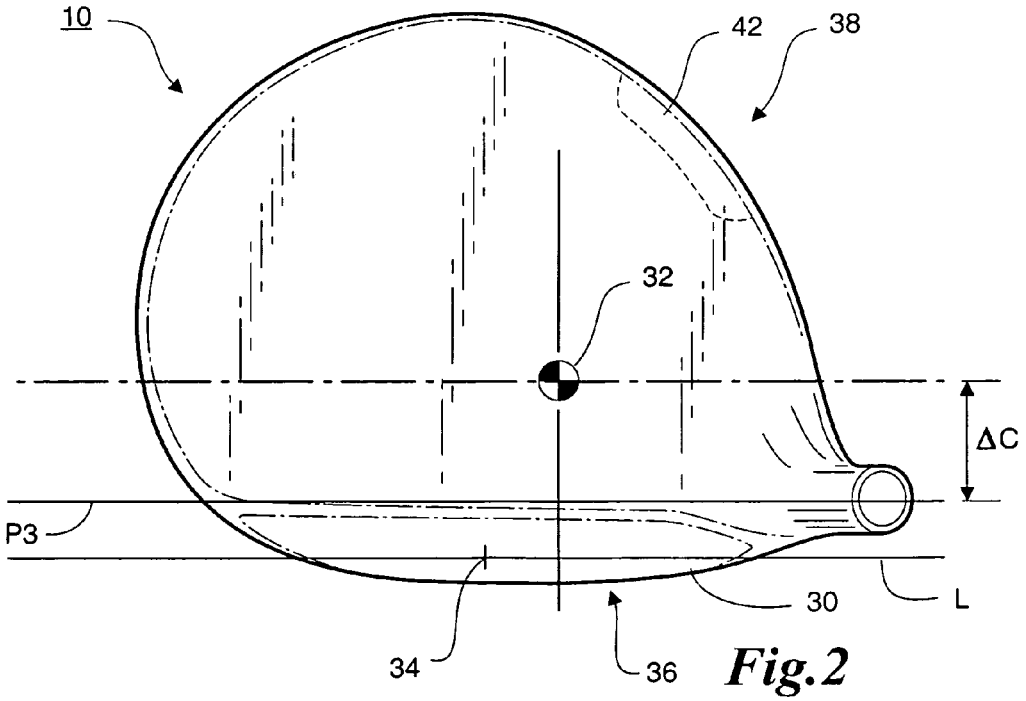
FIG. 2 is a top view of the golf club head of FIG. 1.

With additional reference to FIG. 2, center of gravity 32 is located generally closer to forward end 36 than rear end 38 of club head 10. Specifically, center of gravity 32 is located a distance ΔC equal to 16.0±4.0 millimeters, preferably 16.0±1.0 millimeters toward the rear end 38 from a plane "$P_3$", which contains the shaft axis and is parallel to a line "L" which is horizontal and tangent to the center of the face 34.

With reference again to in FIG. 1, the center of gravity 32 is also displaced inward from the geometric center of the face 34. Specifically center of gravity 32 is positioned a distance ΔA of 36.0±6.0 millimeters, preferably 36.0±1.0 millimeters from a plane "$P_1$" containing the shaft axis normal to plane "$P_3$". Locating the center of gravity 32 closer to forward end 36 and displaced inward toward the heel end 20 of club 10 as described provides an optimally balanced fade and hook type gear effect for a super-oversized driver such as the illustrative embodiment which has a moment of inertia about a vertical axis of at least 1,250 Kg-cm$^2$ and preferably at least 1500 Kg-cm$^2$.

Figure 3:
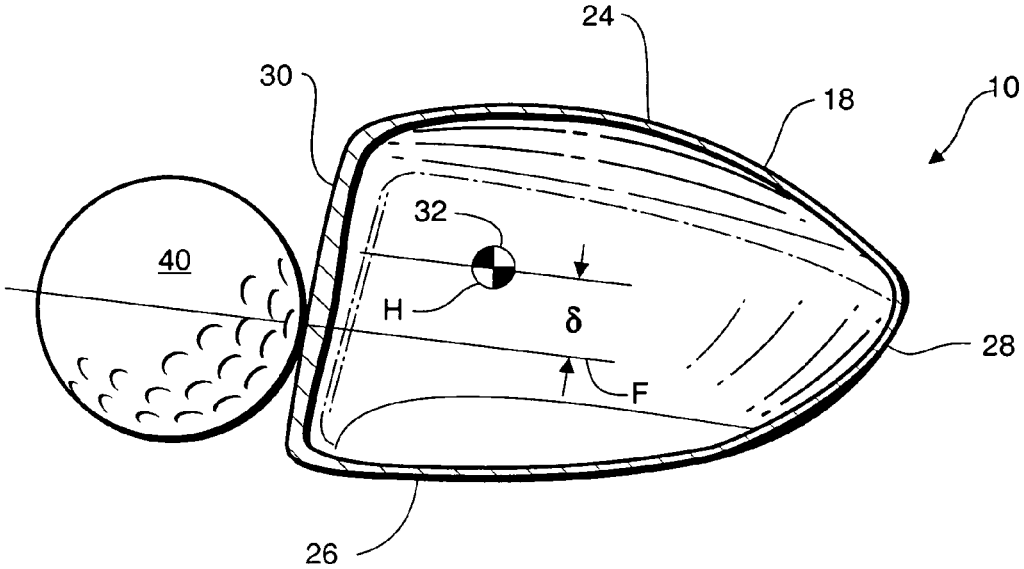
FIG. 3 is a cross-sectional side view of the golf club head of FIG. 1.
Figure 4:
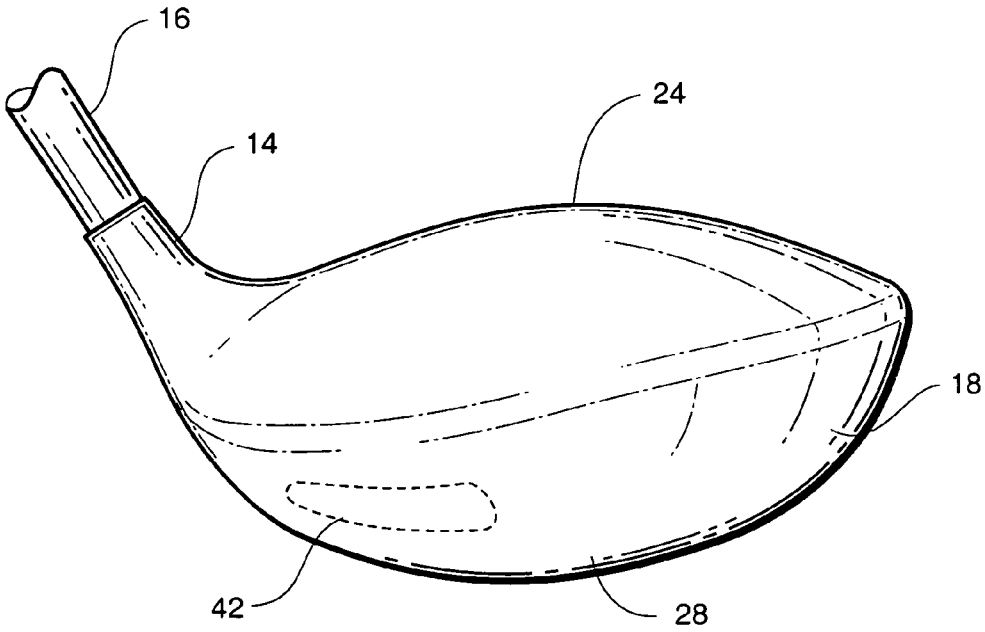
FIG. 4 is a rear view of the golf club head of FIG. 1.
Figure 5:
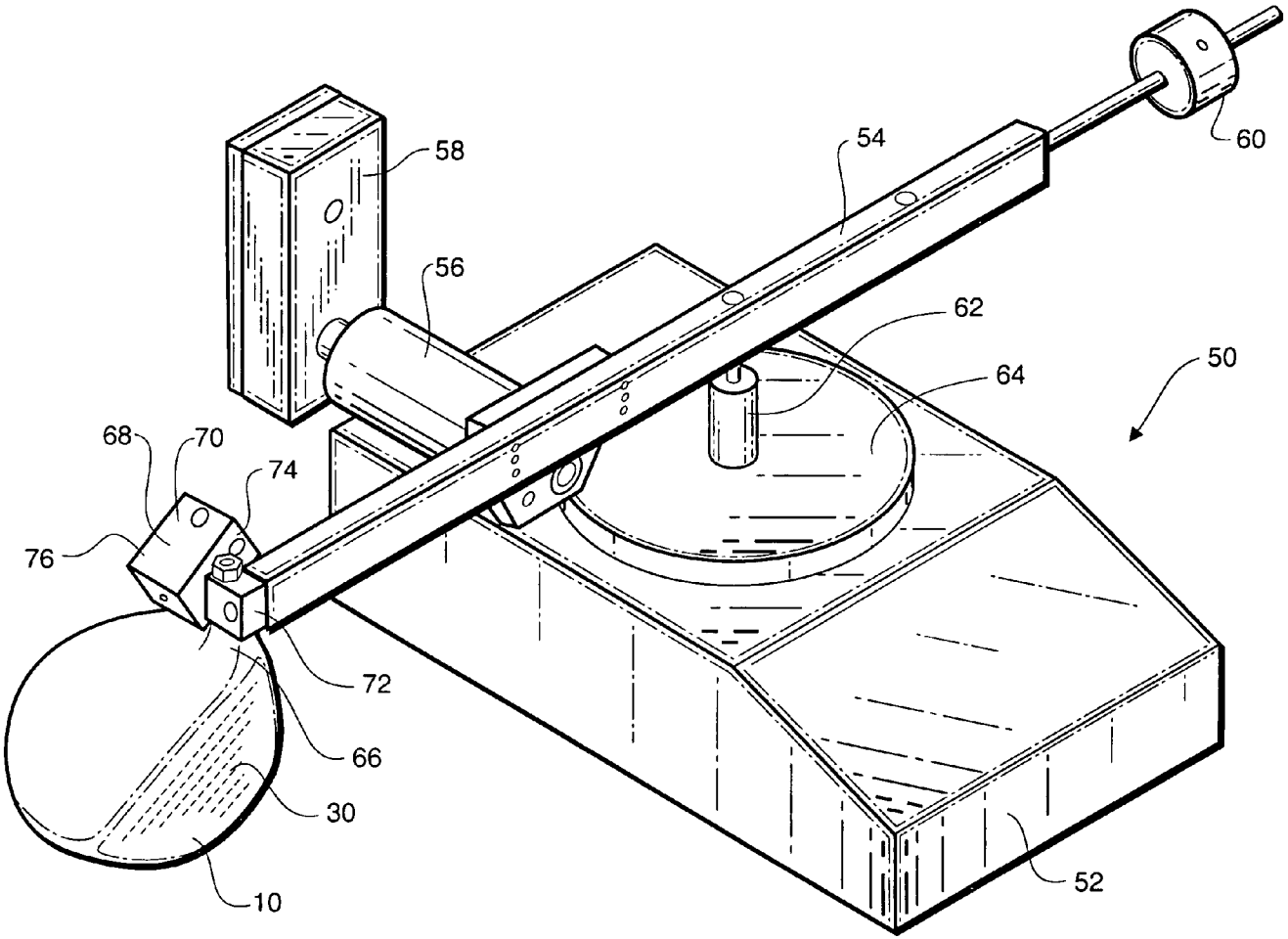
FIG. 5 is an apparatus for determining the location of a the center gravity of a golf club head.

With reference to FIG. 3, club head 10 comprises a sole 26 that is smoothly tapered from approximately 1 millimeter to approximately 0.7 millimeter, a crown 24 that is smoothly tapered from approximately 0.9 millimeter to approximately 0.7 millimeter, and a skirt 28 that is smoothly tapered from approximately 1 millimeter to approximately 0.7 millimeter. The sole plate is devoid of any inefficient structures such as weight pads or any other mass concentrations. However, as shown in FIG. 4, the skirt may have a weight pad 42 of approximately 1 to 5 grams to permit the club head to be swing weighted after casting.

As noted hereinbefore, the moment of inertia of club head 10 about an axis "H" (which extends out of the plane of FIG. 3) through center of gravity 32 is in excess of 800 Kg-cm$^2$. Accordingly, when club 10 impacts ball 40, the line of action between the impact forces "f" and center of gravity 32 are spaced apart by a distance 6. This produces a torque couple that tends to rotate the face 30 of club head 10 downward during impact. The downward movement of face 30 tends to increase the backspin of ball 40 as it leaves the face of club 10. Although the prior art teaches that this type of gear effect induced backspin is undesirable, the inventor of the present invention discovered that in a super-oversized driver the enhanced backspin, in fact, increases performance.

Finally, with reference to FIG. 6 an apparatus 50 for measuring the center of gravity of club head 10 comprises a scale 52, arm 54 mounted to a bearing 56, mounted to a base 58. Arm 54 includes a counterweight 60 and an actuator rod 62 that bears on platen 64 of scale 52. Arm 54 includes a mounting pin 66 which allows a gage block 68 to be mounted to arm 54. Gage block 68 comprises a rectangular body 70 to which is mounted a rotatable secondary body 72.

In order to take a center of gravity measurement a club head 10 is mounted to gage block 68 and with gage block 68 resting on a flat surface, club head 10 is mounted so that face 30 is parallel to upper surface 74 of body 70 and the lie of the club adjusted so that the horizontal axis of club 10 is parallel to side surface 76 of body 70. Once club head 10 is secured to gage block 68, club head 10 is mounted in three orientations, normal to the shaft axis as shown in FIG. 6, normal to upper surface 74 and normal to side surface 76. The moments about bearing 56 are measured and, with the distances from gage block 68 to club head 10 as well as the weight of club head 10 and gage block 68 known, the location of the center of gravity of club head 10 can be determined from balancing the moments about bearing 56.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention shall be limited only to the extent required by the appended claims and the rules and principals of applicable law.

What is claimed is:

1. A golf club head comprising:

a hollow metal body having a heel end, a toe end, a forward end and a rear end, said hollow metal body including a face proximal the forward end adapted for impacting a golf ball, a crown, a skirt, and a sole plate, the sole plate being smoothly contoured and devoid of any mass concentrations;

a hosel adjacent the body heel end for receiving a shaft, said shaft having an axis;

said hollow metal body having a volume of greater than 400 cubic centimeters and a center of gravity located generally closer to the heel end than to the toe end and generally nearer the forward end than the rear end; and the center of gravity being located within a region 2.1±2.0 millimeters above a horizontal plane passing through the center of the face, 16.0±4.0 millimeters toward the rear end from a vertical plane containing the shaft axis that is parallel to a horizontal line tangent to the center of the face, and 36.0±6.0 millimeters toward the toe end from a plane containing the shaft axis that is normal to the vertical plane.

2. The golf club head of claim 1, wherein:

the face has a surface area of least 29 square centimeters.

3. The golf club head of claim 2, wherein:

the face has a surface area from 29 to 36 square centimeters.

4. The golf club head of claim 1, wherein:

the center of gravity is from 1.0 to 3.0 millimeters above the horizontal plane passing through the center of the face.

5. The golf club head of claim 1, wherein:

the face has a thickness that tapers from a maximum thickness of 4.0±1.5 millimeters proximal the center of the face to a minimum thickness of 2.5±1.0 millimeters proximal the perimeter of the face.

6. The golf club head of claim 1, wherein:

said hollow metal body has a moment of inertia of at least 1250 Kg-cm$^2$ about a vertical axis through the center of gravity.

7. The golf club head of claim 1, wherein:

said hollow metal body has a moment of inertia of at least 800 Kg-cm$^2$ about a horizontal axis parallel to said horizontal line tangent to the center of the face through the center of gravity.

8. The golf club head of claim 1, wherein:

the sole plate has a thickness that ranges from 1.2 to 0.7 millimeters in thickness.

9. The golf club head of claim 1, wherein:

the center of gravity is located within a region 2.1±2.0 millimeters above a horizontal plane passing through the center of the face, 16.0±4.0 millimeters toward the rear end from a vertical plane containing the shaft axis that is parallel to a horizontal line tangent to the center of the face, and 36.0±1.0 millimeters toward the toe end from a plane containing the shaft axis that is normal to the vertical plane.

* * * * *